US007156245B2

(12) United States Patent
Lissandre

(10) Patent No.: US 7,156,245 B2
(45) Date of Patent: Jan. 2, 2007

(54) DEVICE FOR DEMOUNTABLE ASSEMBLY OF THE JIB ELEMENTS OF A TOWER CRANE

(75) Inventor: Michel Lissandre, Ecully (FR)

(73) Assignee: Potain, Ecully (FR)

( * ) Notice: Subject to any disclaimer, the term of this patent is extended or adjusted under 35 U.S.C. 154(b) by 190 days.

(21) Appl. No.: 10/799,745

(22) Filed: Mar. 15, 2004

(65) Prior Publication Data

US 2004/0238471 A1 Dec. 2, 2004

(30) Foreign Application Priority Data

Apr. 17, 2003 (FR) ..... 03 04832

(51) Int. Cl.
*B66C 23/70* (2006.01)

(52) U.S. Cl. ..... 212/177; 52/650.1; 52/651.05

(58) Field of Classification Search ..... 212/177; 52/650.01, 651.05, 651.06
See application file for complete search history.

(56) References Cited

U.S. PATENT DOCUMENTS

| | | | | |
|---|---|---|---|---|
| 534,507 A | | 2/1895 | Hoatland | |
| 2,985,264 A | * | 5/1961 | Leonard, Jr. | 52/640 |
| 3,062,340 A | * | 11/1962 | Hunnebeck | 52/646 |
| 3,080,068 A | * | 3/1963 | Felkner | 212/177 |
| 3,085,695 A | * | 4/1963 | Miller | 212/300 |
| 3,204,514 A | | 9/1965 | Sauvet | |
| 3,511,388 A | | 5/1970 | Markwardt | |
| 4,446,975 A | * | 5/1984 | Konig | 212/300 |
| 4,546,591 A | * | 10/1985 | Beltz | 52/645 |
| 4,655,021 A | * | 4/1987 | Franchin et al. | 52/641 |
| 4,815,752 A | * | 3/1989 | Young et al. | 280/406.2 |
| 4,949,516 A | * | 8/1990 | Long, Jr. | 52/645 |
| 5,082,128 A | * | 1/1992 | Franzen et al. | 212/347 |
| 5,199,586 A | * | 4/1993 | Pech et al. | 212/175 |
| 5,344,258 A | * | 9/1994 | Papadopoulos | 405/282 |
| 5,842,587 A | * | 12/1998 | Wanek et al. | 212/177 |
| 6,131,750 A | * | 10/2000 | Harrington | 212/177 |
| 6,213,318 B1 | * | 4/2001 | Walker | 212/177 |
| 6,296,419 B1 | * | 10/2001 | Millet et al. | 403/408.1 |

FOREIGN PATENT DOCUMENTS

| | | | |
|---|---|---|---|
| DE | 37 06 301 C1 | * | 10/1987 |
| DE | 44 02 005 A | | 7/1995 |
| EP | 0 376 417 A | | 7/1990 |
| FR | 1 467 093 A | | 1/1967 |

* cited by examiner

*Primary Examiner*—Thomas J. Brahan
(74) *Attorney, Agent, or Firm*—Oliff & Berridge, PLC

(57) ABSTRACT

The invention is concerned with the demountable assembly of latticework jib elements comprising upper and lower chords connected to one another by means of triangulation bars. In the region of the upper chords, there is provided an assembly by shackle, tenon and a connecting shaft, with abutment and relative positioning means. In the region of the lower chords, there are provided centering pegs and a locking assembly consisting of two connections spaced apart and having clamping and locking means. This device is used for assembling the jib elements and counterjib elements of tower cranes, in particular those having a jib without a masthead and without a tie.

22 Claims, 4 Drawing Sheets

DEVICE FOR DEMOUNTABLE ASSEMBLY OF THE JIB ELEMENTS OF A TOWER CRANE

BACKGROUND OF THE INVENTION

The present invention is concerned, in general terms, with the technical field of tower cranes. This invention relates more particularly to the latticework jibs of tower cranes, and, even more specifically, its subject is a device for demountable assembly of the jib elements of a tower crane. The invention applies more especially to the assembly of the component elements of a crane jib not comprising a projecting part, known as a masthead or jib carrier, projecting above the upper chord of the jib and counterjib and associated with ties.

In a generally known way, a tower crane jib, along which the jib trolley is conventionally displaced, consists of a succession of jib elements which are aligned and assembled with one another so as to form a jib having the desired length. Each jib element is a structure of the latticework girder type, of triangular, rectangular or trapezoidal cross section, which comprises chords which in pairs define plane faces. In each of these plane faces, the two chords are connected to one another by means of elongate pieces of a bar type which together form what is called a "triangulation". This type of structure is also used for the counterjibs of tower cranes which support a counterweight balancing the jib and, where appropriate, the load raised by the crane.

Inasmuch as a foldable crane jib is not concerned, the component elements of the jib of the crane must be capable of being separated from one another for the transport of the crane, and these jib elements have to be assembled with one another, at the place of use of the crane, for the purpose of reforming a crane jib which can be used. The jib elements must therefore, as far as possible, be capable of being assembled with one another easily and also of being conveniently separable from one another.

Moreover, the connection to be made between such jib elements must be adapted to the forces to which these jib elements are subjected, particularly when the crane is operating. If the elements of the "cantilevered" part of the jib of the crane are considered more particularly, the upper chords of these elements are subjected to tensile forces during operation or even at rest, whilst the lower chords of the same jib elements are subject to compressive forces.

The case of the aligned jib placed on the ground on two supports must also be taken into consideration; this is an assembly configuration in which the upper chords of the jib elements are subjected to compressive forces, while the lower chords undergo tensile forces.

The situation where the sling breaks must also be taken into consideration; this is a test case corresponding to the breakage of the slings securing a raised load or to the breakage of the lifting cable, thus giving rise to initially vertical forces which react on the jib elements and on their connections. More particularly, in the event of a sling breakage, the upper chords of the jib elements are subject to compressive forces, while the lower chords of these jib elements undergo tensile forces.

DESCRIPTION OF THE PRIOR ART

There are already various devices for connection between latticework jib elements, of which European patent application EP 0 376 417 A is a particularly representative example. Where this document is concerned, the upper chords of the consecutive jib elements are assemble by means of a hook system, with locking by means of a pin having a bearing shoe. The lower chords of the adjacent jib elements are assembled in a conventional way by means of transverse connecting shafts.

This known device permits easy preassembly of the upper chords, but with the need for a considerable offering angle between two consecutive elements, as illustrated in FIG. 10 of the abovementioned document. By contrast, the device in question does not afford any advantage in terms of the assembly of the lower chords: for this operation, it is necessary to look for coaxiality of the holes of the lower chords by means of the forcible engagement of the connecting shafts (see FIG. 12A).

SUMMARY OF THE INVENTION

In view of this prior art, the object of the present invention is to provide an improved device for assembling the jib elements of a tower crane, in particular of the type mentioned above, which makes it easy to assemble the jib elements on the ground, in order to reduce the time and tools necessary for assembly, while at the same time avoiding the difficulty involved in producing it, the proposed solution also allowing "in the air" assembly or demounting of the jib elements which is easy and can be carried out in complete safety.

To achieve this, the subject of the invention is a device for demountable assembly of the latticework jib elements of a tower crane or other similar latticework structure, the said elements comprising upper chords and lower chords connected to one another by means of triangulation bars, this assembly device being essentially characterized in that, in the region of the upper chords, there is provided an assembly by shackle and tenon connected demountably by means of a shaft, with:

- a shackle integral with an upper chord end of an element to be assembled, the shackle possessing two branches located in parallel vertical planes and pierced with main coaxial cylindrical holes of a diameter corresponding to the diameter of a connecting shaft,
- a tenon integral with another upper chord end of an element to be assembled, the tenon being located in a vertical plane and being pierced with an oblong hole,
- the connecting shaft capable being engaged through the main cylindrical holes of the shackle and the oblong hole of the tenon, and,
- on the shackle and the tenon, complementary abutment means acting in a substantially vertical direction and in a substantially horizontal direction, for the relative positioning of the shackle and of the abutment during assembly.

In a simple embodiment, the abutment means acting in a substantially vertical direction consist of an abutment plate joining the two branches of the shackle in their lower part and cooperating with the lower face of the tenon.

The abutment means acting in a substantially horizontal direction advantageously consist, on the one hand, of a rotary positioner seated in the shackle and produced in the form of a shaft passing through two secondary coaxial cylindrical holes formed respectively in the two branches of the shackle, the shaft-shaped rotary positioner are being provided with a flat and with manipulating and immobilizing means which make it possible to bring the flat into and maintain it in a vertical position, facing the location of the connecting shaft, or in a horizontal position, these abutment means consisting, on the other hand, of a substantially vertical plane front face of the tenon.

The means for manipulating and immobilizing the rotary positioner comprise, for example, a control handle connected to one end of this rotary positioner, and at least one immobilizing pin engageable into a diametral hole of an end region of the rotary positioner and into a lateral tab integral with a branch of the shackle. The or each pin serves more particularly for immobilizing the rotary positioner in its angular position in which its flat is in the horizontal position. The abovementioned lateral tab advantageously possesses an indentation provided for cooperating with the handle for manipulating the rotary positioner, at the same time forming an abutment stopping this positioner in its angular position in which its flat is in the vertical position.

The connecting shaft, of cylindrical general shape, engaged through the shackle and the tenon possesses a widened head at one end, while its other end comprises a diametral hole provided for receiving an immobilizing pin, the connecting shaft thus formed having its head connected by means of a short connecting cable to the shackle or to a member retained on this shackle. For example, the connecting cable connects the head of the connecting shaft to the rotary positioner, in particular to a pin of this positioner.

According to a preferred embodiment of the device for the assembly of jib elements, which is the subject of the present invention, there are provided, in the region of the lower chords of the elements to be assembled:

- two centering pegs integral with one end of an element to be assembled, the axes of the centering pegs being oriented in the longitudinal direction of the said element,
- two holes corresponding respectively to the two centering pegs and formed at another end of an element to be assembled, and
- a locking assembly consisting of two connections spaced apart from one another, with clamping and locking means, the said connections being provided for joining the mutually adjacent ends of the two jib elements, in the region of their lower chords.

In a particular embodiment, each centering peg comprises, starting from an outer tip, in succession: a frustoconical first part of smaller diameter and relatively elongate; another frustoconical part arranged in the prolongation of the preceding part, of larger diameter and relatively short, with a cone aperture angle larger than that of the frustoconical first part; a cylindrical calking part attached to the structure of the jib element in the region of the lower chords. In particular, the centering pegs are mounted on an end crossmember of the "stringer" of the jib element, that is to say of the horizontal lower latticework of this jib element, composed, on the one hand, of the lower chords forming a rolling crack for the jib trolley and, on the other hand, of crossbracing bars or diagonals, the centering pegs being located in the region of the lower chords.

As regards the two holes provided so as to correspond to the two centering pegs, these are formed, in the region of the lower chords, on another end crossmember of the "stringer" of the jib element, at that end of this element which is opposite that carrying the centering pegs.

According to one embodiment, each of the two connections of the locking assembly comprises a clamping shaft mounted slideably on a jib element, in the region of the lower chords, in the longitudinal direction of this element, between a retracted storage position and an advanced assembly position, the clamping shaft possessing a receptacle provided for receiving a locking wedge of the connection. Each clamping shaft itself comprises, from the rear forward, a guide sheet or plate, a widened head forming an abutment, a cylindrical part provided with a receptacle for receiving the locking wedge, and a tip, the guide sheet or plate cooperating with a slideway fastened to the jib element, in particular welded to the end crossmember of the "stringer" of the jib element. The slideway comprises an abutment member, such as a pin, provided for limiting the retraction of the clamping shaft into the storage position, as a result of cooperation with the guide sheet or plate. This clamping shaft passes in a freely slideable manner through a corresponding orifice of the end crossmember of the "stringer" of the jib element. The locking wedge of the connection, adapted to the corresponding receptacle of the clamping shaft, itself receives a pin for securing this locking wedge.

Overall, the assembly device which is the subject of the invention possesses, as compared with the prior art, the following advantages:

- This device does not require any handling of the connecting parts which are all guided and/or retained on the jib elements to be assembled.
- The device does not require any force or tools in order to engage the connecting shafts; this engagement is easily carried out by hand.
- The device overcomes any difficulty in the alignment of the various members to be connected, and it does not present any risk of jamming, this being the result, in particular, of the tenon with the oblong hole and of the centering carried out with the aid of the conical pegs and by virtue of the jib element's own weight.
- The demounting of the assembly, too, is carried out essentially by hand and without any force, particularly with regard to the removal of the connecting shafts and the retraction of the clamping shafts. Only the locking wedges require a blow with the aid of a hammer in order to install them and remove them. The positions necessary for eliminating the forces on the connecting parts are implemented with the aid of a handling appliance.
- The time necessary for assembling the jib elements or for demounting them can thus be reduced.

DESCRIPTION OF THE DRAWING

The invention will be understood more clearly from the following description, with reference to the accompanying diagrammatic drawing illustrating by way of example an embodiment of this device for demountable assembly of the jib elements of a tower crane.

DESCRIPTION OF THE PREFERRED EMBODIMENT

Figure 1:
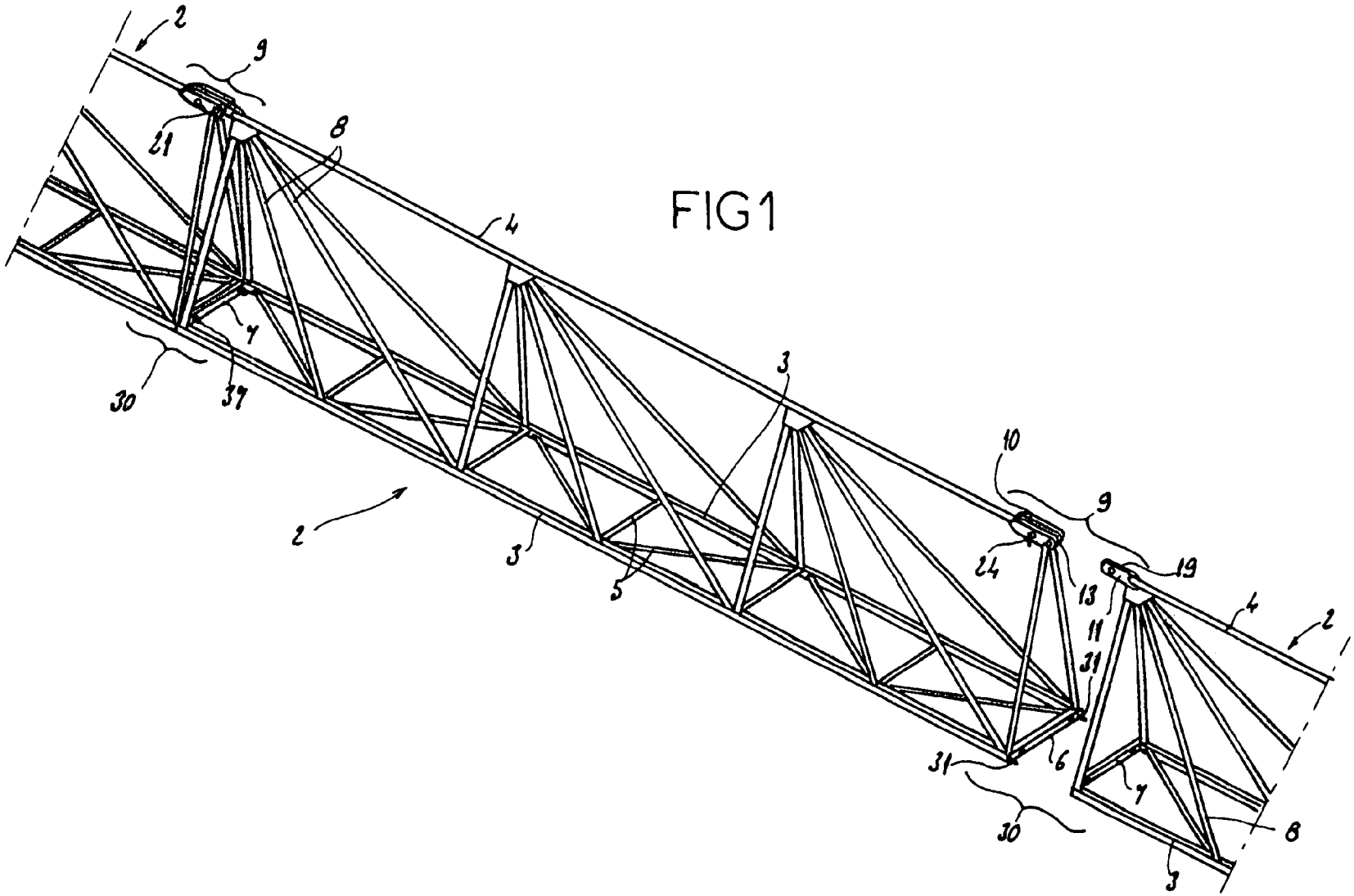
FIG. 1 illustrates, in perspective, a jib element provided with the assembly device according to the present invention, with adjacent jib elements being partially illustrated.

As shown in FIG. 1, the invention applies particularly to the assembly of jib elements 2 provided to be aligned and connected end to end so as to form a complete crane jib of the desired length. Each jib element 2 is a structure of the latticework girder type, having (in the example illustrated) a triangular cross section. Thus, here, the jib element 2 comprises two lower chords 3 and a single upper chord 4 which define a horizontal lower face and two inclined lateral faces.

In the horizontal lower face of the jib element 2, the two lower chords 3 are connected to one another by means of transverse or oblique bars 5. The corresponding ends of the two lower chords 3 are also connected by means of end crossmembers 6 and 7 respectively. The two lower chords 3 also form the rolling track for the jib trolley.

In each of the two inclined lateral faces of the jib element 2, the lower chord 3 is connected to the upper chord 4 by means of other straight or oblique bars 8 which form a suitable "triangulation".

Of more particular interest, here, are arrangements provided at the ends of the jib elements 2 and illustrated in detail in the following figures and provided for assembling these jib elements 2 with one another.

Figure 2:
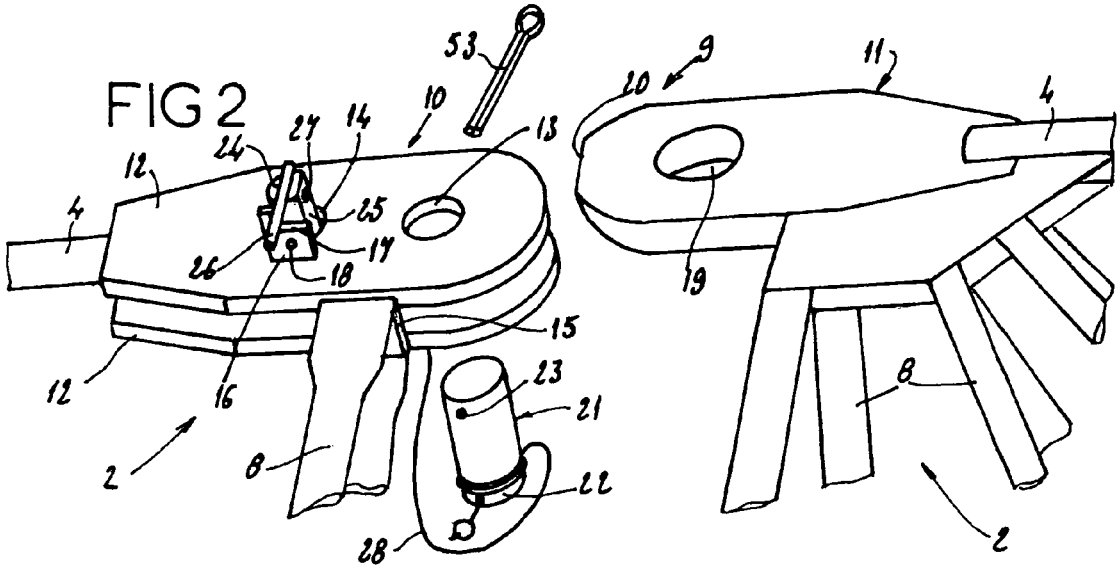
FIG. 2 is a perspective view of the components making the connection in the region of the upper chords, before assembly.
Figure 3:
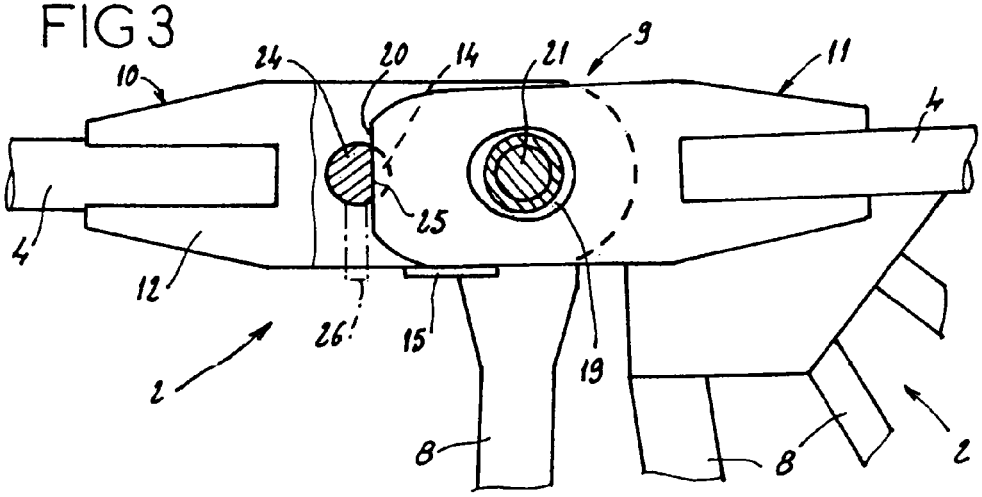
FIG. 3 is a partially sectional front view of the components making the connection in the region of the upper chords, during assembly.
Figure 4:
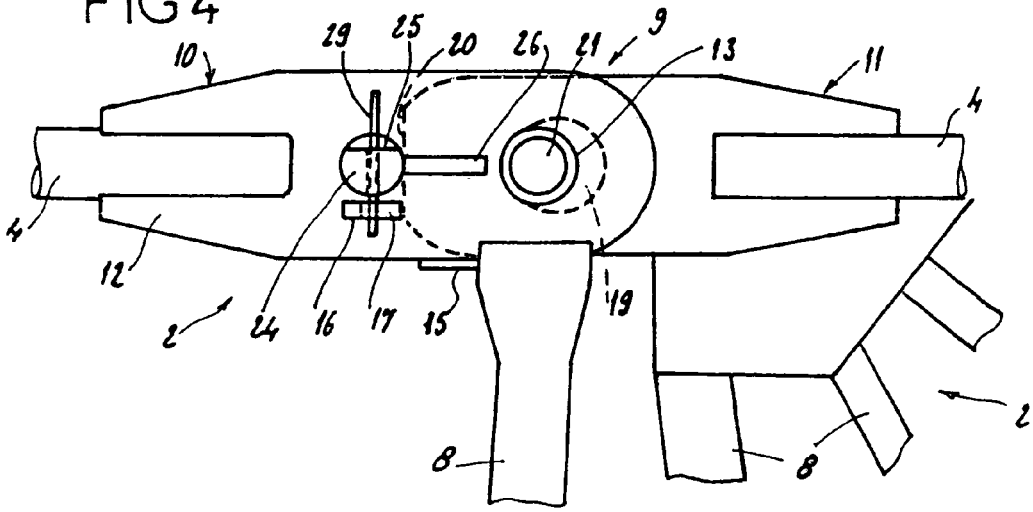
FIG. 4 is a front view of the same components, after assembly.

In particular, FIGS. 2 to 4 show the components which make the connection, designated as a whole by the reference 9, in the region of the upper chords 4 of the jib elements 2 to be assembled. The connection 9 is of the type with a shackle and tenon and with a connecting shaft, having a shackle 10 integral with the front end of the upper chord 4 of a first jib element 2, and having a tenon 11 complementary to the shackle 10 and integral with the rear end of the upper chord 4 of a second jib element 2.

More particularly, the shackle 10 possesses two plate-shaped branches 12 located in vertical planes parallel to one another and to the longitudinal direction of the jib element 2. The two branches 12 of the shackle 10 are pierced with main coaxial cylindrical holes 13, the diameter of which corresponds to that of the connecting shaft (described below). These two branches 12 are also pierced with secondary coaxial cylindrical holes 14 located at the rear of the two main holes 13 and provided for receiving a rotary positioner (described below).

The two branches 12 of the shackle 10 are joined in their lower part by means of a substantially horizontal abutment plate 15, in particular welded under the lower edges of the two branches 12.

Welded to the outer face of one of the branches 12 of the shackle 10 is a substantially horizontal lateral tab 16 which serves as a stop abutment for the rotary positioner. For this purpose, the tab 16 has an indentation 17. This tab 16 is also pierced with a hole 18 provided for receiving a pin.

The tenon 11 is located in a vertical place, and it is pierced with an oblong hole 19, the longitudinal direction of which is substantially horizontal. The tenon 11 has at its free end a plane and substantially vertical machined end face 20.

The connecting shaft 21 has a cylindrical general shape, but with a widened head 22 at one of its ends. Toward its other end, the connecting shaft 21 comprises a diametral hole 23 provided for receiving an immobilizing pin.

The rotary positioner 24 takes the form of a horizontal shaft which is seated in the shackle 10 and which, more particularly, passes through the two secondary holes 14 of the branches 12 of the shackle 10. This rotary positioner 24, of cylindrical general shape, has a flat 25 laterally. A control handle 26, produced in the form of a simple radial rod, is fastened to an outer end of the rotary positioner 24, on the side where the lateral tab 16 is located. Toward its two ends, the rotary positioner 24 also comprises diametral holes 27 provided for receiving respectively two pins for immobilizing this rotary positioner 24.

The connecting shaft 21 is connected "captively" to the shackle 10 by means of a short retaining cable 28 which connects the widened head 22 of this connecting shaft 21 to the rotary positioner 24.

By means of the arrangements described above, the rotary positioner 24 can be displaced angularly, with the aid of its control handle 26, between two positions separate from one another as a result of a rotation through 90°:

- In the first position, called the mounting position, and shown in FIGS. 2 and 3, the flat 25 of the rotary positioner 24 is in the vertical position, facing the location of the connecting shaft 21; the control handle 26 then occupies a downwardly directed vertical position, in which it cooperates with the indentation 17 of the lateral tab 16 which then forms a vertical and axial positioning abutment.
- In the second position, called the operating position, shown in FIG. 4, the flat 25 of the rotary positioner 24 is in the horizontal position and directed upward; the positioner 24 is then immobilized in position by a pin 29 introduced vertically through a diametral hole 27 of this positioner 24 and through the hole 18 of the lateral tab 16.

Figure 5:
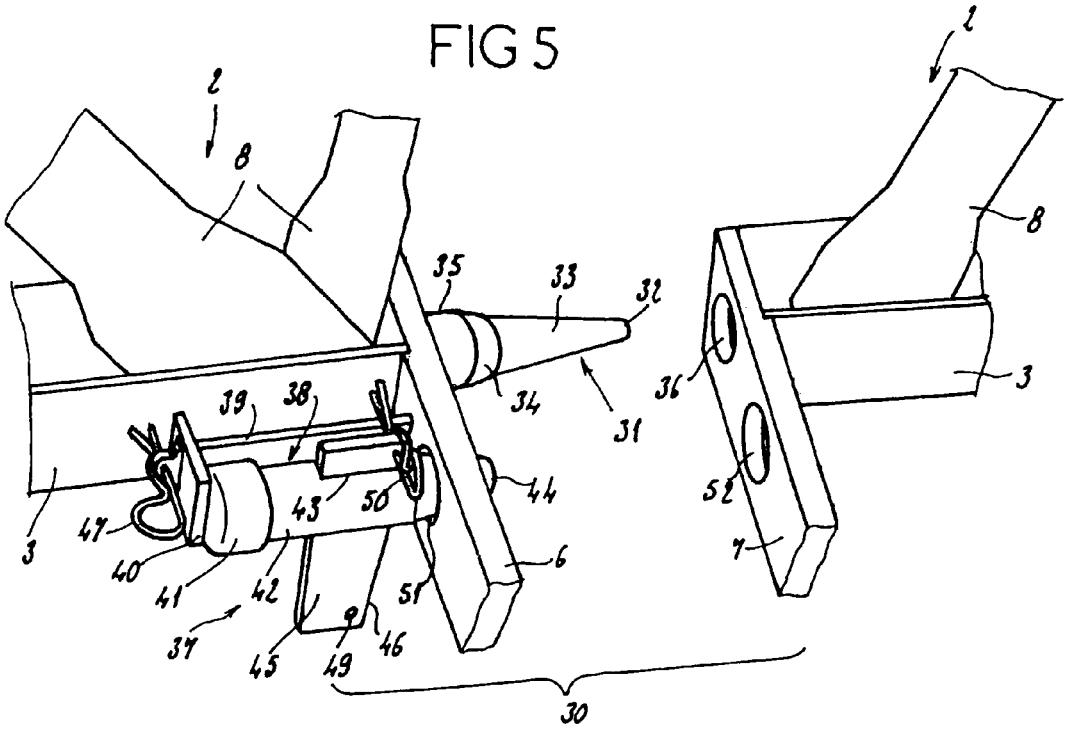
FIG. 5 is a perspective view of the components making: the connection in the region of the lower chords, before assembly.
Figure 6:
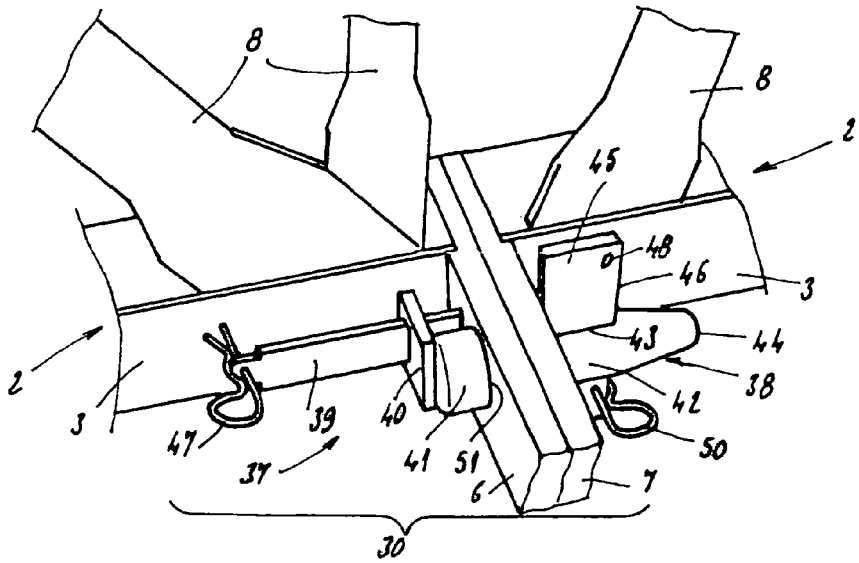
FIG. 6 is a perspective view of the components making the connection in the region of the lower chords, after assembly.

FIGS. 5 and 6 show the components which make the connection, designated as a whole by the reference 30, in the region of the lower chords 3 of the jib elements 2 to be assembled. More particularly, these components are associated with the end crossmembers 6 and 7 of the respective "stringers" of the jib elements 2.

Fastened to the front end of a jib element 2 are two centering pegs 31, the axes of which are oriented in the longitudinal direction of the jib element 2. These two centering pegs 31 are fastened respectively toward the two ends of the front end crossmember 6 of the jib element 2, hence in the region of the lower chords and of the rolling track, as also shown in FIG. 1. Referring more particularly to FIG. 5, each centering peg 31 has a conical general configuration and comprises, from its free end and in the direction of the crossmember 6:

- a rounded tip 32;
- a frustoconical first part 33 of smaller diameter and relatively long;
- a frustoconical second part 34 of larger diameter and relatively short, with a cone aperture angle larger than that of the frustoconical first part 33;
- a cylindrical calking part 35.

Corresponding to the positions of the two centering pegs 31, the rear end crossmember 7 of a jib element 2 comprises, toward its ends, two cylindrical holes 36, the diameter of which corresponds to that of the. cylindrical calking part 35 of each centering peg 31.

The components which make the connection 30 in the region of the lower chords 3 also comprise a locking assembly consisting of two symmetrical connections 37 spaced apart from one another, each connection 37 being located in the vicinity of a centering peg 31, on the "inner" side with respect to this centering peg 31.

Each connection 37 comprises a clamping shaft 38 mounted slideably at the front of the jib element 2, in the longitudinal direction of this element, parallel to a slideway 39 welded to the front crossmember 6 of the jib element 2 and extending rearwardly parallel to a lower chord 3.

The clamping shaft 38 comprises, from the rear forward:

- a guide sheet 40 which cooperates with the slideway 39 which passes through a slot or notch of the guide sheet 40;
- a widened shaft head 41, to the rear face of which the guide sheet 40 is welded;
- a cylindrical shaft part 42 provided with a receptacle in the form of a vertical slot 43;
- a front shaft end in the form of a tip 44.

The receptacle in the form of a vertical slot 43 of the clamping shaft 38 is provided for receiving a locking wedge 45 of the connection 37. The locking wedge 45 comprises an edge with a slope 46, while the slot-shaped receptacle 43 possesses an end face inclined at an angle corresponding to the slope of the wedge 45, this angle being, for example, equal to approximately 6°.

The connection 37 also comprises, at the rear end of the slideway 39, a pin 47 forming an abutment member for the clamping shaft 38. The locking wedge 45 is pierced with an upper hole 48 and with a lower hole 49, another pin 50 being capable of being engaged into one or other of these two holes 48 and 49.

Finally, each connection 37 comprises, on the front crossmember 6 of the jib element 2, a cylindrical hole 51, in which the clamping shaft 38 is mounted in a freely slideable manner, and, on the rear crossmember 7 of the jib element 2, a corresponding cylindrical hole 52 provided for the clamping shaft 38 to pass through it (in the advanced assembly position according to FIG. 6).

The use of the assembly device described above is as follows:

The jib elements 2 are assembled on the ground. Referring to FIG. 1, it is assumed that a jib element 2 rests on the ground on horizontal supports (not illustrated), the front end of this jib element 2 having, projecting, a shackle 10 in the region of its upper chord 4 and two centering pegs 31 in the region of its lower chords 3.

The next jib element 2 (illustrated partially on the right in FIG. 1) is brought opposite the preceding jib element 2, in a position inclined slightly to the horizontal, with the aid of a handling appliance and of slings, and this approach may also be considered as being illustrated in FIG. 2 as regards the upper parts of the two jib elements 2. The rotary positioner 24 carried by the shackle 10 has previously been placed in the mounting position, that is to say with its flat 25 in the vertical position.

Still with the aid of the handling appliance, the tenon 11 of the second jib element 2 is engaged between the two branches 12 of the shackle 10 and is brought into vertical and horizontal abutment: the vertical abutment results from the bearing of the lower edge of the tenon 11 on the abutment plate 15 integral with the shackle 10, while the horizontal abutment results from the bearing of the end face 20 of the tenon 11 against the flat 25 of the rotary positioner 24—see FIG. 3.

The oblong hole 19 of the shackle 11 is then placed so as to correspond to the two main holes 13 of the shackle 10, and the connecting shaft 21 is engaged through these three holes. The pin 53 (see also FIG. 2) is placed into the hole 23 of the connecting shaft 21 in order to ensure that the latter is immobilized axially.

Subsequently, the second jib element 2 is aligned with the first jib element 2 as a result of a rotation of the second jib element 2 about the previously installed connecting shaft 21. Toward the end of this rotational movement which takes place about the connecting shaft 21 located in the region of the upper chord 4, the centering pegs 31 located in the region of the lower chords 3 of the first jib element 2 engage into the corresponding holes 36 of the rear crossmember 7 of the second jib element 2. More particularly, the action of the centering pegs 31 breaks down as follows:

- The frustoconical first part 33 of each centering peg 31 effects an initial prepositioning.
- The frustoconical second part 34 effects a centering, at the same time taking up the variations in positioning tolerance of the pegs 31 in relation to the corresponding holes 36.
- The cylindrical calking part 35 ensures an exact relative positioning of the two jib elements 2 and also the absorption of the shearing forces attributable to the rolling load, this cylindrical part 35 being placed finally in the corresponding hole 36.

FIG. 5 shows the centering peg 31 before engagement in the corresponding hole 36, while FIG. 6 illustrates the position obtained after complete engagement, the rear crossmember 7 of the second jib element 2 finally having come to bear against the front crossmember 6 of the first jib element 2.

Each connection 37 located in the region of the lower chords 3 is then clamped, by the clamping shaft 38 being advanced by sliding along the slideway 39 and through the hole 51 of the front crossmember 6 of the jib element 2, the clamping shaft 38 also engaging through the corresponding hole 52 of the rear crossmember 7 of the second jib element 2. The locking wedge 45 is put in place in order to lock this connection 37.

Subsequently, the connection 9 made in the region of the upper chords 4 is locked by means of a rotation of the positioner 24 through 90°, controlled by the manipulation of the handle 26 and bringing the rotary positioner 24 into the operating position, its flat 25 being horizontal (see FIG. 4). The rotary positioner 24 is immobilized in terms of rotation in this operating position by the pin 29 being put in place.

The second jib element 2, henceforth assembled rigidly with the first jib element 2, in alignment with the first element, is finally keyed by supports being introduced under this second jib element 2.

The assembly of the next jib elements 2 takes place according to the same process, until a crane jib of the desired length is obtained.

For demounting and separating the elements 2 of a jib, which operations are likewise carried out on the ground, the following procedure is adopted:

- The second jib element 2 (that located furthest forward) is held by the handling appliance by means of slings.
- In the region of the upper connection 9, the rotary positioner 24 is oriented manually by means of its control handle 26, so as to return it flat 25 into the vertical position, opposite the connecting shaft 21.
- The locking wedges 45 of the two connections 37 located in the region of the lower chords 3 are disengaged from their respective receptacles 43.
- The clamping shafts 38, released in this way, are retracted by sliding along their respective slideways 39, until their guide sheets 40 abut against the pin 47.
- The second jib element 2 is pivoted upward about the connecting shaft 21 with the aid of the handling appliance, so as to disengage the centering pegs 31 completely.

The connecting shaft 21 is then removed, so as to eliminate the connection between the shackle 10 and the tenon 11.

The two jib elements 2 in question are then separated, and, of course, the same operation will be repeated for all the elements of the jib.

Figure 7:
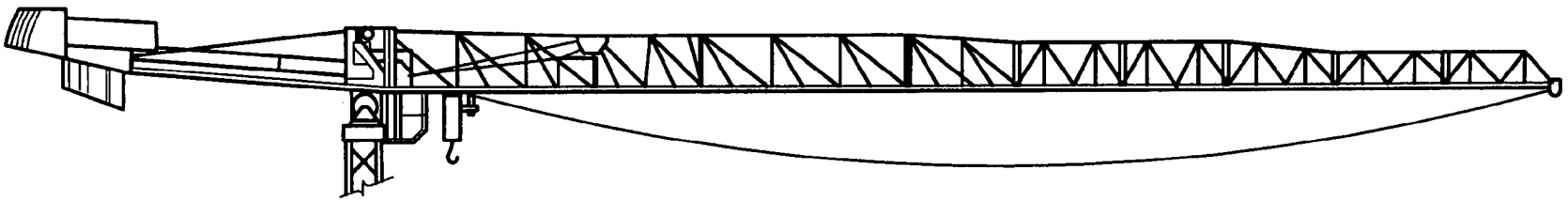
FIG 7 Prior Art
FIG. 7 is an illustration of a generic example of a crane without a masthead.

The assembly device described above can be used, in particular, for the demountable connection of the elements of a tower crane jib without a masthead and without a jib tie (see FIG. 7 for an example of a crane without a masthead). It also applies to the counterjibs of such cranes, inasmuch as these counterjibs possess a latticework structure. However, the invention is still also applicable to the jibs and counterjibs of tower cranes with a masthead and with ties, in particular with regard to the cantilevered part of the jibs of cranes with a masthead and with ties, for which part the upper chord or chords are subjected to tensile forces.

There would be no departure from the scope of the invention, as defined in the accompanying claims:

with regard to the assembly by shackle and tenon, provided in the region of the upper chords, if the details of the abutment and positioning means were modified;

with regard to the assembly carried out in the region of the lower chords, if the details of the locking assembly were modified;

if the device which is the subject of the invention were used partially, in particular with the invention being used in order to make the connection in the region of the upper chords, but if another device, such as a device according to the prior art, were used in order to make the connection in the region of the lower chords;

if the same assembly device were used for jib or counterjib elements in the form of a latticework of a cross section other than triangular, for example with a rectangular, square or trapezoidal cross section, the assembly by shackle and tenon being, of course, duplicated in the case of such a cross section defined by two upper chords;

if this assembly device were intended for cranes of all types, with latticework jib and/or counterjib;

if the same device were used for assembling the component elements of other latticework structures similar to crane jibs, for example if the invention were applied to a fore-nose of a handling gantry or to a bracket crane.

The invention claimed is:

1. A device for assembly of latticework jib elements of a latticework structure, each of the jib elements including upper chords and lower chords connected to one another by triangulation bars, the device comprising:

an upper connection including:

a connecting shaft;

a shackle configured to mount to an upper chord end of a first jib element of the jib elements to be assembled, the shackle including two parallel branches oriented in vertical planes, and each of the two branches including a main coaxial cylindrical hole with a diameter corresponding to a diameter of the connecting shaft, a tenon configured to mount to an upper chord end of a second jib element of the jib elements to be assembled, the tenon being oriented in a vertical plane and including an oblong hole, the connecting shaft being configured to be engaged through the main coaxial cylindrical holes of the shackle and through the oblong hole of the tenon to detachably connect the shackle and the tenon, and each of the shackle and the tenon including complementary abutment means acting in a substantially vertical direction during assembly and complementary abutment means acting in a substantially horizontal direction during assembly to position the shackle and the tenon.

2. The device according to claim 1, wherein the abutment means acting in the substantially vertical direction includes an abutment plate joining lower parts of the two branches of the shackle and cooperating with a lower face of the tenon.

3. The device according to claim 1, wherein the abutment means acting in the substantially horizontal direction includes:

a rotary positioner including a flat and a means for manipulating and immobilizing the rotary positioner, the rotary positioner being a shaft seated in the shackle by passing the shaft through two secondary coaxial cylindrical holes formed respectively in the two branches of the shackle, the means for manipulating and immobilizing the rotary positioner being capable of rotating the flat and maintaining the flat between a vertical position in which the flat faces the connecting shaft and a horizontal position in which the flat faces away from the connecting shaft; and a substantially vertical plane front face of the tenon.

4. The device according to claim 3, wherein the means for manipulating and immobilizing the rotary positioner includes a control handle connected to one end of the rotary positioner and at least one immobilizing pin engageable into a diametral hole disposed in an end region of the rotary positioner and engageable into a lateral tab integral with one of the two branches of the shackle.

5. The device according to claim 4, wherein the at least one immobilizing pin is configured to immobilize a rotation of the rotary positioner to fix an angular position in which the flat is in the horizontal position.

6. The device according to claim 4, wherein the lateral tab includes an indentation provided to cooperate with the control handle to manipulate the rotary positioner, the indentation forming an abutment configured to stop the rotary positioner at the angular position in which the flat is in the vertical position.

7. The device according to claim 3, wherein a connecting cable connects a head of the connecting shaft to the rotary positioner.

8. The device according to claim 7, wherein the connecting cable connects the head of the connecting shaft to a pin of the rotary positioner.

9. The device according to claim 1, wherein the connecting shaft includes a substantially cylindrical shape, a widened head at one end of the connecting shaft, and a diametral hole at another end of the connecting shaft, wherein the diametral hole is configured to receive an immobilizing pin, and wherein the head of the connecting shaft is configured to be connected by a short connecting cable to at least one of the shackle and a member retained on the shackle.

10. The device according to claim 1, in a region of the lower chords, further comprising:

a lower connection including:

two centering pegs configured to be located at an end of the first jib element to be assembled, an axis of each of the centering pegs being oriented in a longitudinal direction of the first and second jib elements, two holes respectively corresponding to the two centering pegs and configured to be located at an end of the second jib element to be assembled, the end of the second jib element being mutually adjacent to the end of the first jib element, and a locking assembly including two connections spaced apart from one another, each of the connections including a clamping and locking means, each of the connections being configured to join the mutually adjacent ends of the first and second jib elements in a region of the lower chords of each of the first and second jib elements.

11. The device according to claim 10, wherein each of the two centering pegs comprises, in succession:

an outer tip;

a frustoconical first part including a first diameter, a first length substantially elongated in the longitudinal direction of the first and second jib elements, and a first cone aperture angle;

a frustoconical second part including a larger diameter than the first diameter of the frustoconical first part, a second length shorter than the first length of the frustoconical first part, and a second cone aperture angle larger than the first cone aperture angle of the frustoconical first part; and a cylindrical calking part configured to be attached to the first jib element, in the region of the lower chords.

12. The device according to claim 10, wherein the centering pegs are configured to be mounted on a first end crossmember of a stringer of the first jib element, the stringer being a horizontal lower latticework of the first jib element, the stringer including the lower chords of the first jib element to form a rolling track for a jib trolley, the stringer including diagonal crossbracing bars, and wherein the centering pegs are located in the region of the lower chords of the first jib element.

13. The device according to claim 12, wherein the two holes corresponding to the two centering pegs are configured to be located in the region of the lower chords of the second jib element and on a second end crossmember of a stringer of the second jib element, the second end crossmember being disposed at that the end of the second jib element which opposes the first end crossmember carrying the two centering pegs.

14. The device according to claim 10, wherein each of the two connections of the locking assembly comprises a clamping shaft configured to be mounted slideably on the first jib element, in the region of the lower chords of the first jib element and in the longitudinal direction of the first and second jib elements, between a retracted storage position and an advanced assembly position, the clamping shaft including a receptacle provided to receive a locking wedge of the connection.

15. The device according claim 14, wherein each clamping shaft includes, in succession, a tip, a guide member, a widened head forming an abutment, and a cylindrical part including the receptacle that receives the locking wedge, the guide member cooperating with a slideway configured to be fastened to the first jib element.

16. The device according to claim 15, wherein the slideway includes an abutment member provided for limiting a retraction of the clamping shaft into the retracted storage position in cooperation with the guide member.

17. The device according to claim 16, wherein the abutment means of the slideway comprises a pin.

18. The device according to claim 15, wherein the clamping shaft is configured to pass, in a freely slideable manner, through a corresponding orifice of the second end crossmember of the stringer of the second jib element.

19. The device according to claim 15, wherein the slideway is configured to be welded to the first end crossmember of the stringer of the first jib element.

20. The device according to claim 14, wherein the receptacle includes an end face inclined at an angle corresponding to a slope of the locking wedge.

21. The device according to claim 14, wherein the locking wedge receives a pin to secure the locking wedge.

22. The device according to claim 1, wherein the shackle and the tenon are configured to be removably mounted to the first jib element and the second jib element of the tower crane, which is devoid of a jib tie and a masthead.

* * * * *